US007231898B2

(12) United States Patent
Letourneau et al.

(10) Patent No.: US 7,231,898 B2
(45) Date of Patent: Jun. 19, 2007

(54) INTAKE MANIFOLD CROSS TALK SEALING

(75) Inventors: Mark Letourneau, Dover Centre (CA); Lisa Whaley, Wheatley (CA)

(73) Assignee: Siemens Canada Limited, Chatham (CA)

( * ) Notice: Subject to any disclaimer, the term of this patent is extended or adjusted under 35 U.S.C. 154(b) by 0 days.

(21) Appl. No.: 11/185,669

(22) Filed: Jul. 20, 2005

(65) Prior Publication Data

US 2007/0017468 A1 Jan. 25, 2007

(51) Int. Cl.
*F02M 35/10* (2006.01)

(52) U.S. Cl. ..... 123/184.21

(58) Field of Classification Search ..... 123/184.21, 123/184.61, 184.38, 184.31; 277/592, 591
See application file for complete search history.

(56) References Cited

U.S. PATENT DOCUMENTS 5,005,535 A * 4/1991 Binversie et al. ..... 123/184.39
5,590,888 A * 1/1997 Brummer et al. ..... 277/591
5,947,483 A * 9/1999 Brummer et al. ..... 277/592
6,662,772 B1 * 12/2003 Murphy ..... 123/184.21
6,763,802 B1 * 7/2004 Brassell ..... 123/336

FOREIGN PATENT DOCUMENTS

JP 2001152862 A * 6/2001
JP 2002070671 A * 3/2002
JP 2002106428 A * 4/2002

* cited by examiner

*Primary Examiner*—Stephen K. Cronin
*Assistant Examiner*—Hyder Ali

(57) ABSTRACT

A flange seal molded as a single piece from a synthetic material which can withstand the high heat and pressure produced by the engine. The flange seal is shaped to correspond the intake manifold housing. Connecting portions on the flange seal separate the individual port openings. The flange seal is located between the intake manifold housing and the cylinder head to seal the joint. Pressure is applied to the flange seal when the fasteners are tightened to aid in sealing.

22 Claims, 4 Drawing Sheets

INTAKE MANIFOLD CROSS TALK SEALING

BACKGROUND OF THE INVENTION

The invention provides an arrangement for sealing an intake manifold assembly at a cylinder head.

An intake manifold assembly controls the amount of air entering internal combustion engines. Air enters the intake manifold assembly and flows through to the cylinder head of the engine. Intake manifolds use shaft and blade assemblies to control the intake of air into the manifold assembly. The intake manifold assembly is mounted on the cylinder head and fastened into place. A seal must be created at the joint between the intake manifold assembly and the cylinder head to prevent fluid from leaking at the joint during operation of the vehicle.

Commonly to achieve the desired amount of sealing separate seals are made for each port from the intake manifold housing to the cylinder head. The separate seals make assembly of the intake manifold housing and cylinder head difficult. The seals must each be retained in position relative to the intake manifold housing and the cylinder head to ensure proper assembly. Fasteners or retention devices are required to hold the individual seals in the proper locations. The prior art seals are placed in seal mounts and clips formed on the seals retain the seals to the seal mounts during assembly of the intake manifold and engine.

In addition to sealing the joint between the intake manifold assembly and the cylinder head, the seals must be able to withstand the high temperatures and pressure that are created by the engine during operation of the vehicle.

Therefore, an arrangement for sealing an intake manifold assembly at a cylinder head is needed.

SUMMARY OF THE INVENTION

An intake manifold assembly includes a housing, an intake insert, and a flange seal. The flange seal of the present invention is molded as a single piece from a synthetic material that can withstand the high temperatures and pressure produced by operation of the engine. The flange seal is shaped to correspond to a flange seal mount within the intake manifold housing. The flange seal and the flange seal mount follow the same contours as the intake manifold housing. Connecting portions on the flange seal separate and seal the individual port openings.

The intake insert is assembled into the intake manifold housing and the flange seal is placed within the flange seal mount. The intake manifold assembly is mounted to the cylinder head of the engine. Fasteners retain the intake manifold assembly to the cylinder head. The flange seal is located between the intake manifold housing and the cylinder head to seal the joint. Pressure is applied to the flange seal when the fasteners are tightened.

In addition to the flange seal further sealing is achieved through shaft isolators located at the shaft mounting locations. The intake insert also fits within the intake manifold housing in a manner that creates a seal between the intake manifold housing and the intake insert once assembled.

These and other features of the present invention can be best understood from the following specification and drawings, the following of which is a brief description.

DETAILED DESCRIPTION OF THE PREFERRED EMBODIMENT

Figure 1:
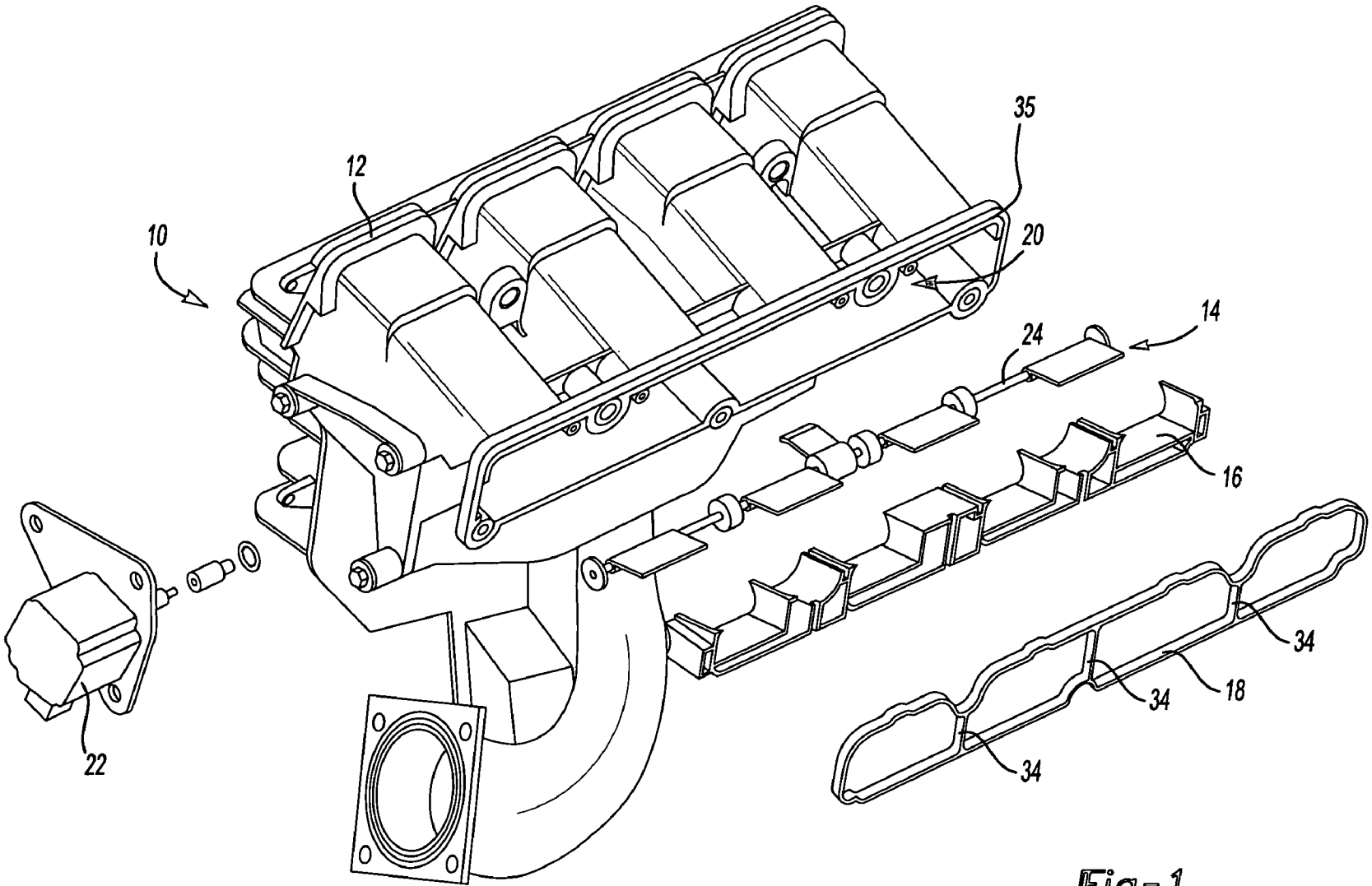
FIG. 1 shows an exploded view of an intake manifold assembly.

FIG. 1 shows an intake manifold assembly 10. The intake manifold assembly 10 includes a housing 12, a shaft assembly 14, an intake insert 16, and a flange seal 18. The shaft assembly 14 is assembled into an opening 20 within the housing 12. The intake insert 16 is placed within the opening 20 to retain and support the shaft assembly 14. The flange seal 18 is assembled last. The flange seal 18 seals around the opening 20 once the intake manifold assembly 10 is mounted to the engine. An actuator 22 is mounted on the housing 12 and connected to the shaft assembly 14. During operation of the engine the actuator 22 controls airflow through the main passage of the intake manifold assembly 10 by rotating the shaft 24.

Figure 2:
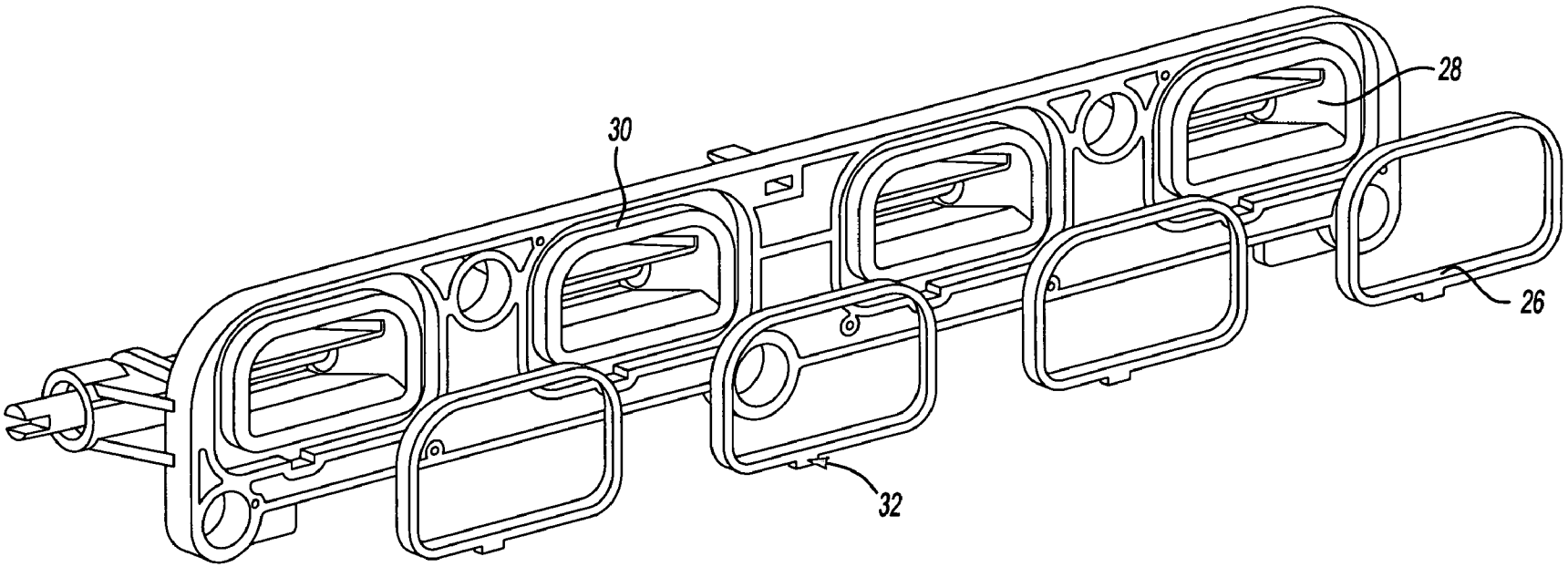
Fig-2 PRIOR ART
FIG. 2 is an exploded view of prior art housing and an seals.

FIG. 2 shows the prior art housing 12 and seals 26. The prior art seals 26 were made to surround each port 28 in the intake manifold housing 12 separately. The ports 28 lead from the intake manifold housing 12 to the cylinder head. The prior art seals 26 were placed in seal mounts 30. Clips 32 were formed on the prior art seals 26, to retain the prior art seals 26 to the seal mounts 30.

Figure 3:
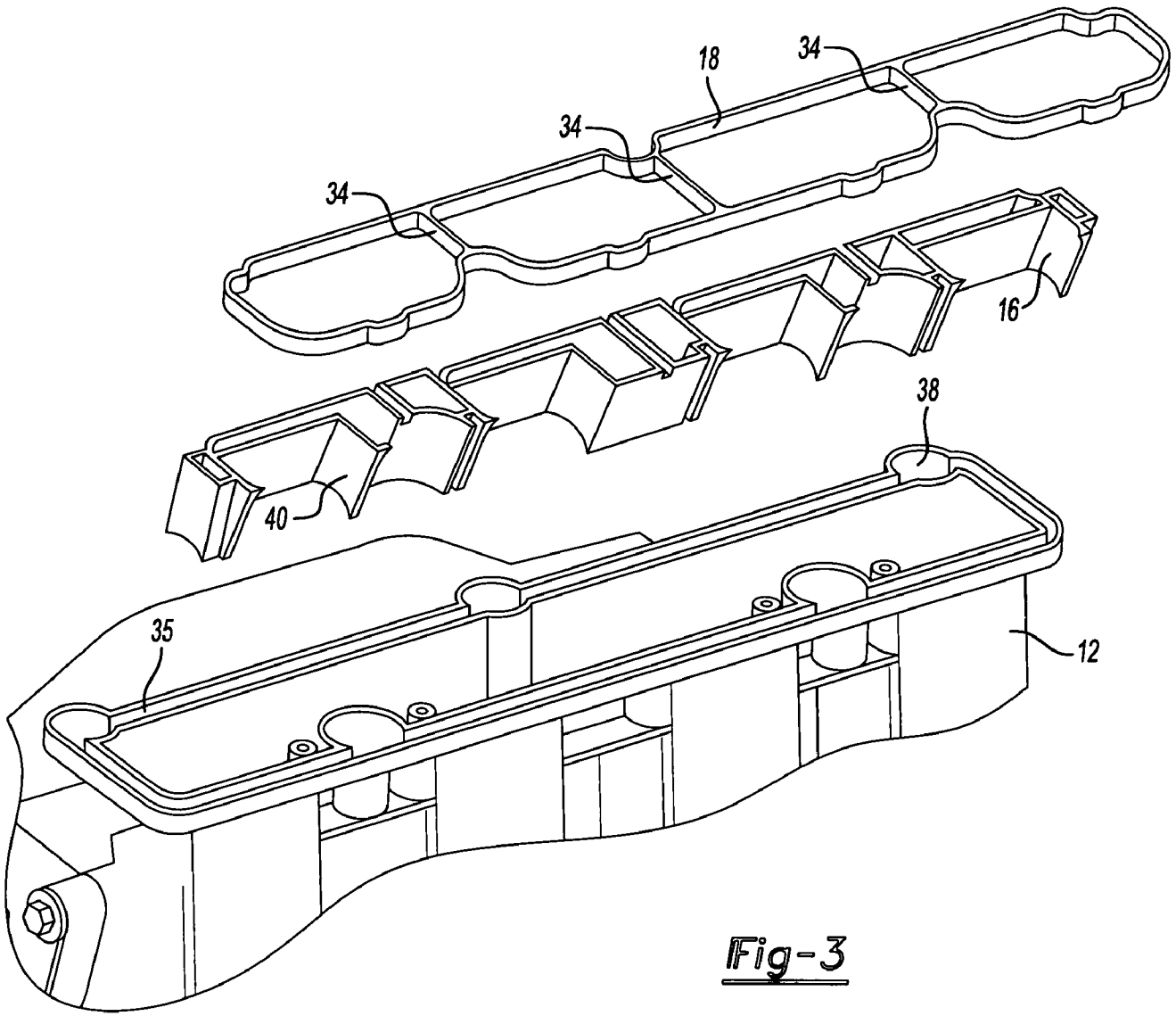
FIG. 3 is an exploded view of an intake manifold housing, intake insert, and flange seal.

FIG. 3 shows an embodiment of the flange seal 18 of the present invention. The flange seal 18 is molded as a single piece from a synthetic material. One skilled in the art would be able to select a proper material for the flange seal which can withstand the high temperatures and pressure produced by the engine. The flange seal 18 is shaped to correspond to a flange seal mount 35 within the housing 12. The flange seal mount 35 follows the same contour and entirely surrounds the opening 20 within the housing 12. In addition, connecting portions 34 on the flange seal 18 separate the individual port openings to provide sealing for each port. In this manner the flange seal 18 also acts as a lateral seal for the intake manifold assembly 10.

The intake insert 16 is assembled into the intake manifold housing 12. Following assembly of the intake insert 16 the flange seal 18 is placed within the flange seal mount 35. The intake manifold assembly 10 is mounted to the cylinder head 36 of the engine. Fasteners extend through fastener holes 38 retain the intake manifold assembly 10 to the cylinder head 36 (Shown in FIG. 4). The flange seal 18 is positioned between the intake manifold housing 12 and the cylinder head 36. Pressure is applied to the flange seal 18 by the fasteners to aid in seal the joint once the fasteners are tightened.

Figure 4:
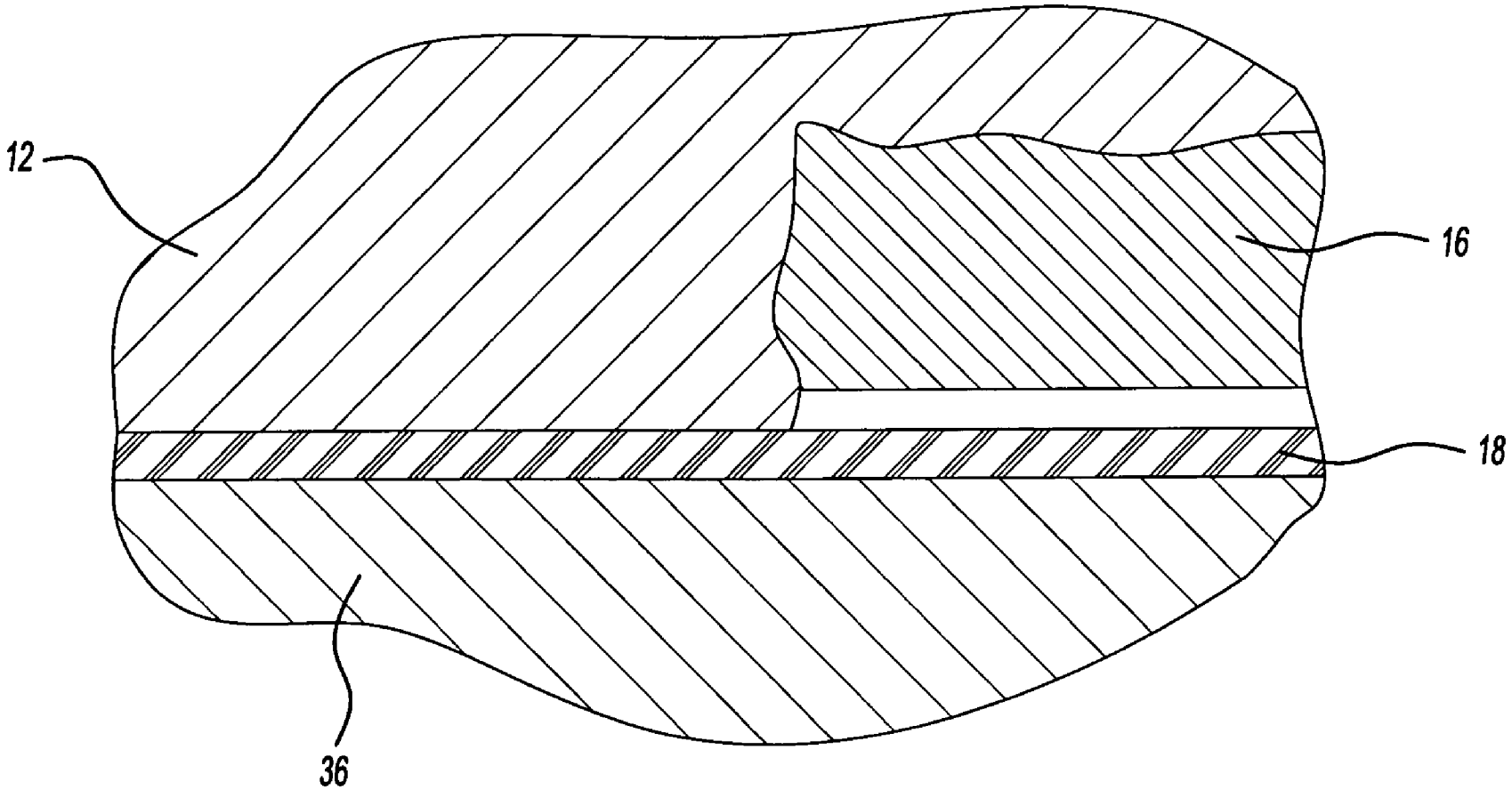
FIG. 4 is a cross-section showing the intake manifold housing, flange seal and cylinder head.

FIG. 4 shows a cross-section of the assembled intake manifold housing 12, flange seal 18, and cylinder head 36. The flange seal 18 is positioned between the intake manifold housing 12 and the cylinder head 36. A portion of the intake manifold housing 12 is cut-out to show the intake insert 16. Due to variances during assembly there may be a gap between the intake insert 16 and the flange seal 18 as shown. Preferably, however, the flange seal 18 and the intake insert 16 are in contact to eliminate areas where fluid may pool or leak.

In addition to the flange seal 18 further sealing is achieved through shaft isolators 40 on the intake insert 16 located at the shaft mounting locations. The intake insert 16 also fits within the intake manifold housing 12 in a manner that creates over stressing during the assembly process. That is, the intake insert 16 has a press fit within the intake manifold housing 12. The press fit creates a seal between the intake manifold housing 12 and the intake insert 16 once assembled.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An intake manifold assembly comprising:

an intake manifold housing including a housing wall having a plurality of port openings, wherein a flange seal mount is formed in the intake manifold housing;

a single flange seal at least partially located within the flange seal mount, wherein the flange seal surrounds the plurality of port openings; and an intake insert located within the intake manifold housing and partially supports a portion of the flange seal and that defines a partial portion each of the plurality of port openings.

2. The intake manifold assembly of claim 1, wherein the flange seal is molded as one piece.

3. The intake manifold assembly of claim 1, wherein the flange seal is located between the intake manifold housing and a cylinder head.

4. The intake manifold assembly of claim 1, wherein the flange seal includes a plurality of lateral portions.

5. The intake manifold of claim 4, wherein one of the plurality of lateral portions is located between each of the plurality of port openings.

6. The assembly as recited in claim 4, wherein the intake insert supports the plurality of lateral portions of the flange seal.

7. The intake manifold assembly of claim 1, wherein the flange seal mount comprises an indent formed in the intake manifold housing that surrounds an outer perimeter of the plurality of openings.

8. The intake manifold of claim 1, wherein the flange seal mount retains the flange seal in position prior to assembly of the intake manifold housing to a cylinder head.

9. The intake manifold of claim 1, wherein the flange seal entirely surrounds each of the plurality of port openings.

10. The assembly as recited in claim 1, wherein the intake defines only a partial periphery of each of the plurality of port openings, and the intake manifold housing defines the remaining periphery of each of the plurality of port openings.

11. The assembly as recited in claim 10, including shaft assembly held within said intake manifold housing by said intake insert.

12. An intake manifold assembly comprising:

an intake manifold housing including a housing wall having a plurality of port openings, wherein a flange seal mount is formed in the intake manifold housing;

a single flange seal adjacent the housing wall, wherein the flange seal is at least partially located within the flange seal mount, and wherein the flange seal surrounds each of the plurality of port openings; and an intake insert located within the intake manifold housing and partially supports a portion of the single flange seal, the intake insert defining a portion of a periphery of each of the plurality of the of port openings, and the intake manifold housing defining a remaining portion of said periphery of each of the plurality of port openings.

13. The intake manifold assembly of claim 12, wherein the flange seal is molded as one piece.

14. The intake manifold assembly of claim 12, wherein the flange seal mount comprises an indent formed in the intake manifold housing disposed about all of the plurality of port openings.

15. The intake manifold assembly of claim 12, wherein the flange seal mount retains the flange seal in position prior to assembly of the intake manifold housing to the cylinder head.

16. The intake manifold assembly of claim 12, wherein the flange seal entirely surrounds each of the plurality of port openings.

17. A method of assembling an intake manifold assembly, the method comprising the steps of:

providing an intake manifold housing having a plurality of port openings, wherein a flange seal mount is formed in the intake manifold housing;

positioning a single flange seal at least partially within the flange seal mount such that the flange seal surrounds each of the plurality of port openings; and assembling an intake insert within the intake manifold housing supporting a portion of the single flange seal and for partially defining each of the plurality of port openings.

18. The method of claim 17, further comprising the step of mounting the intake manifold housing on a cylinder head to position the flange seal between the cylinder head and the intake manifold housing.

19. The method of claim 18, further comprising the step fastening the intake manifold housing on the cylinder head to apply a load to the flange seal.

20. The method of claim 18, wherein the step of positioning the flange further includes retaining the flange seal in position with the flange seal mount prior to the step of mounting the intake manifold housing.

21. The method of claim 17, wherein the step of positioning the flange further includes positioning the flange seal such that a portion of the flange seal individually surrounds each of the plurality of port openings.

22. The method of claim 17, wherein the step of positioning the flange seal further includes positioning each of the plurality of lateral portions between each of the plurality of port openings.

* * * * *